US005645287A

United States Patent [19]

Soo

[11] Patent Number: 5,645,287

[45] Date of Patent: Jul. 8, 1997

[54] FRAME FOR IN-LINE ROLLER SKATE

[76] Inventor: Mike Soo, No. 931, Chung Shan Rd., Jen Teh Hsiang, Tainan Hsien, Taiwan

[21] Appl. No.: 538,877

[22] Filed: Oct. 4, 1995

[51] Int. Cl.[6] ..... A63C 17/14

[52] U.S. Cl. ..... 280/11.2

[58] Field of Search ..... 280/11.12, 11.18, 280/11.2, 11.22, 11.23, 11.27, 11.3

[56] References Cited

U.S. PATENT DOCUMENTS

| | | | |
|---|---|---|---|
| 2,166,767 | 7/1939 | Petermann | 280/11.22 |
| 3,009,709 | 11/1961 | Ware | 280/11.2 |
| 5,028,058 | 7/1991 | Olson | 280/11.2 |
| 5,046,746 | 9/1991 | Gierveld | 280/11.22 |
| 5,314,199 | 5/1994 | Olson et al. | 280/11.27 |
| 5,415,419 | 5/1995 | Borque | 280/11.2 |

*Primary Examiner*—Kevin Hurley
*Assistant Examiner*—Frank Vanaman
*Attorney, Agent, or Firm*—Townsend and Townsend and Crew LLP

[57] ABSTRACT

An improved frame for an in-line roller skate consists of a body portion formed by extrusion molding of aluminum alloy, and front and heel sole attaching portions formed by a plastic molding and a brake assembly. The front and heel sole attaching portions are respectively mounted on a front plate and a rear plate defined on the body portion wherein the heel sole attaching portion has a level higher than that of the front sole attaching portion. The brake assembly has a housing having a top tongue inserted into the heel sole attaching portion and a pair of side walls pivotably attached to the body portion.

6 Claims, 5 Drawing Sheets

FRAME FOR IN-LINE ROLLER SKATE

FIELD OF THE INVENTION

The present invention is related to a frame for an in-line roller skate, and, particularly, to a frame which consists of four main portions, namely, a body portion, a front sole attaching portion, a heel sole attaching portion, and a brake assembly wherein the body portion is formed by extrusion molding of aluminum alloy.

BACKGROUND OF THE INVENTION

A conventional frame for an in-line roller skate is generally formed by several ways. The first is that a frame consists of a plurality of aluminum plates which are formed by pressing and then assembled together by screwing. This way has the disadvantages that it is relatively laborious concerning the assembly of the frame, the formed frame has a relatively poor stability, and the connection of the pressed aluminum plates by screwing may loosen after the in-line roller skate has been used for a period of time.

The second is that a frame is formed by a plastic molding; for example, a Polycarbonate (PC) molding has two side wall portions which are connected together by being screwed and spaced apart a fixed distance by spacing rods. The frame formed this way has a better stability than the first.

The third is aimed to improve the second. The third is an integral plastic molding; for example, a Polycarbonate (PC) molding to integrally form the frame for the in-line roller skate.

However, for the following reasons, the second and third ways for forming the frame have their disadvantages in nature: the molding conditions are very complicated and critical to the performance of the frame; if the molding conditions (for example, the molding temperature) have even a minor variation, the obtained frame may not have sufficient strength to withstand an impact acting thereon. Furthermore, a plastic frame does not have a satisfactory structural rigidity.

Thus, a fourth way for forming the frame is suggested. The fourth way uses an extrusion molding of aluminum alloy to form the frame. FIG. 1 of the present application shows a profile of a frame 80 (indicated by thick phantom lines thereof) in accordance with the fourth way. In forming the frame 80, the fourth way is first to extrude a stock of aluminum to become a blank with two side walls 84 (only one is shown) which have a generally rectangular shape and three webs 81, 82 and 83 connecting the two side walls 84 together. Then a material removing operation (for example, milling) is performed on the blank to obtain the shown frame 80, which has a front sole attaching portion and a heel sole attaching portion having a level higher than that of the former. By this design the front and heel sole attaching portions have different levels and the in-line roller skate can have a better operability. However, by a single operation of extrusion molding, it is impossible to form the frame 80 to have the two sole attaching portions having different levels.

Although the frame 80 formed by the fourth way can have an excellent rigidity, stability and operability for the skate, the fourth way has a disadvantage that the machining of the extruded blank into the frame 80 requires a lot of laborious work, which causes the frame 80 to have a relatively high cost of manufacturing, which, in turn, causes the in-line roller skate incorporating the frame 80 to have an unacceptable high price.

SUMMARY OF THE INVENTION

It is an objective of the present invention to provide a frame for an in-line roller skate which may have the advantages of the frame formed by the above, mentioned fourth way but not have the disadvantages thereof.

A further objective of the present invention is to provide a frame for an in-line roller skate which has a body portion being formed by extrusion molding of aluminum alloy.

It is a further objective of the present invention to provide a frame for an in-line roller skate which has a front and a heel sole attaching portion which are formed by a plastic molding and can be very easily and firmly mounted on the body portion wherein the heel sole attaching portion has a level higher than that of the front sole attaching portion.

It is still an objective of the present invention to provide a frame for an in-line roller skate which has a brake assembly with a tongue engaging the heel sole attaching portion.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
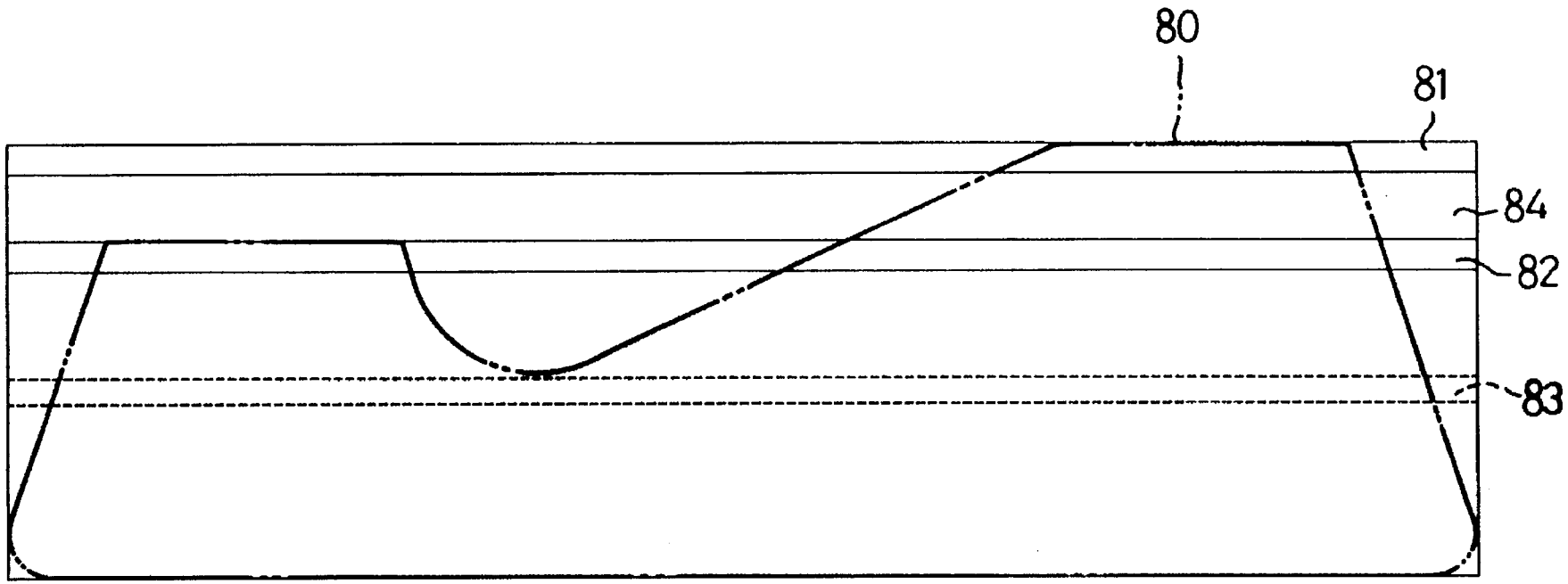
FIG. 1 PRIOR ART
FIG. 1 is a side view showing a profile of a blank for forming a frame for a conventional in-line roller skate and the frame obtained from the blank, which is indicated by thick phantom lines.
Figure 2:
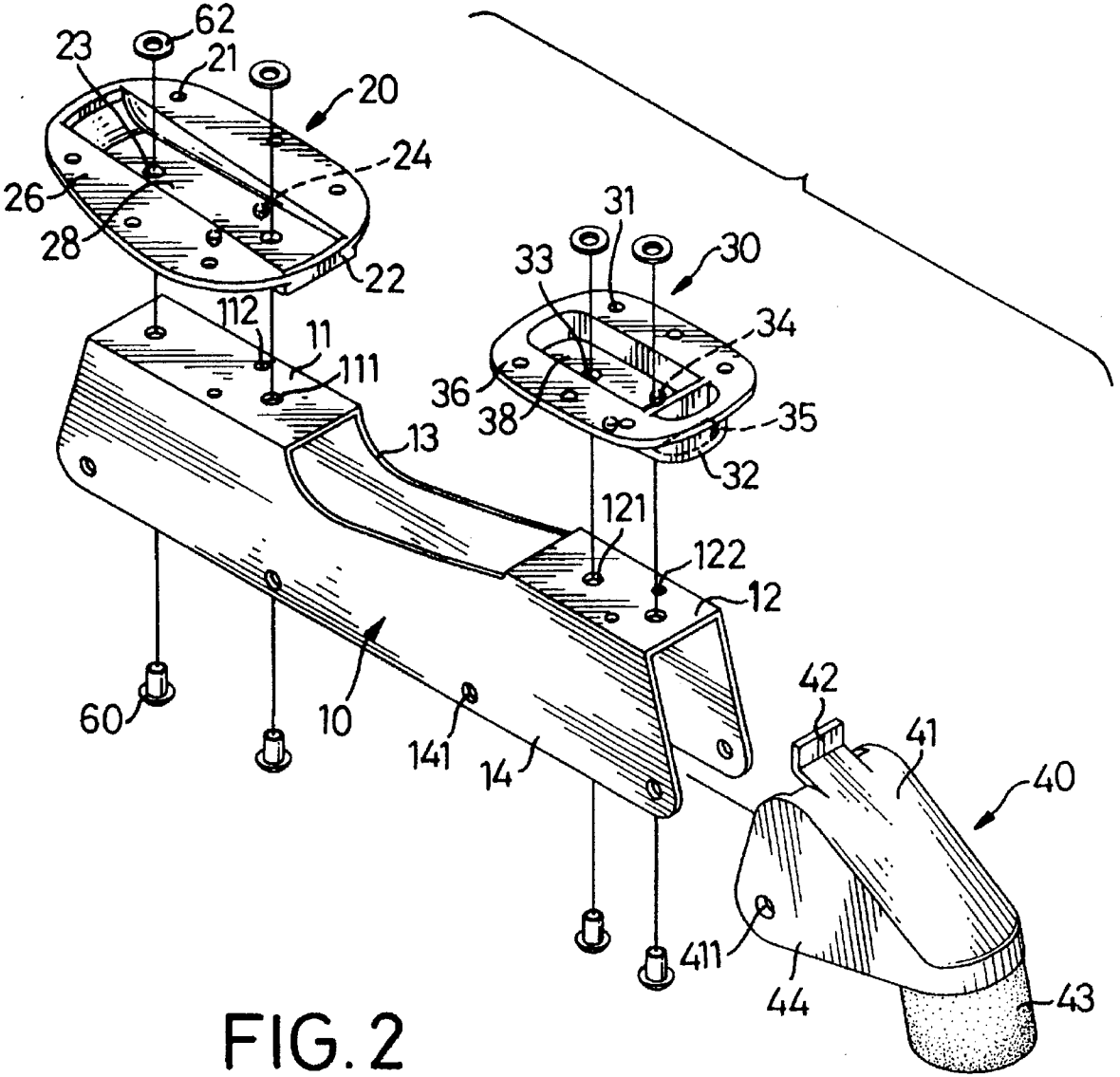
FIG. 2 is an exploded, perspective view showing the parts constituting a frame in accordance with the present invention.

Referring to FIG. 2 of the present application, a frame for an in-line roller skate in accordance with the present invention consists of a body portion 10, a front sole attaching portion 20, a heel sole attaching portion 30, and a brake assembly 40.

The body portion 10 is formed by extrusion molding of aluminum alloy to have two side walls 14 and a top plate connecting the two side walls 14 together. Four pairs of holes 141 are formed (for example, by drilling) in the side walls 14 thereby to receive four wheel shaft assemblies. A machining (for example, milling) operation is performed on a central part of the body portion 10 to define a curved cutout 13 on the central part thereby to divide the top plate into a front plate 11 and a rear plate 12. Two rivet receiving holes 111 and two locating holes 112 are defined in the front plate 11, wherein a line connecting the two rivet receiving holes 111 and a line connecting the two locating holes 112 generally define a Latin cross. Likewise, two rivet receiving holes 121 and two locating holes 122 are defined in the rear plate 12.

The front sole attaching portion 20 is formed by a plastic molding; for example, a Polycarbonate (PC) molding, to have a base 22 and a pair of inclined sole attaching flanges 26 integrally formed with the base 22 and extending beside and above the base 22 thereby to define a recess 28 between the base 22 and the flanges 26. Three pairs of sole fastening holes 21 are defined in the sole attaching flanges 26 to facilitate a sole of a boot to be fixedly fastened on the front sole attaching portion 20. A pair of locating protrusions 24 are formed on a bottom face of the base 22. A pair of rivet receiving holes 23 are defined in the base 22. The relative positions of the locating protrusions 24 and the rivet receiving holes 23 correspond to those of the locating holes 112 and the rivet receiving holes 111 respectively.

The heel sole attaching portion 30 is also formed by a plastic molding; for example, a Polycarbonate (PC) molding, to have a base 32 and a pair of flat sole attaching flanges 36 integrally formed with the base 32 and extending beside and above the base 32 thereby to define a recess 38 between the flanges 36 and the base 32. Three pairs of sole fastening holes 31 are defined in the sole attaching flanges 36 to facilitate a heel portion of the sole of the boot to be fixedly fastened on the heel sole attaching portion 30. A pair of locating protrusions 34 are formed on a bottom face of the base 32. A pair of rivet receiving holes 33 are defined in the base 32. The relative positions between the locating protrusions 34 and the rivet receiving holes 33 correspond to those between the locating holes 122 and the rivet receiving holes 121 respectively. The heel sole attaching portion 30 further defines a cavity 35 at a rear end thereof.

The brake assembly 40 has a housing 41 formed by a plastic molding and a braking block 43 made of rubber and fixedly attached to the housing 41 by a known means; for example, gluing. At a left, top end of the housing 41, there is provided a tongue 42. A pair of holes 411 are respectively defined in a pair of side walls 44 of the housing 41.

Four rivet assemblies including four rivets 60 and washers 62 are used to fixedly mount the front sole attaching portion 20 and the heel sole attaching portion 30 on the body portion 10.

Figure 3:
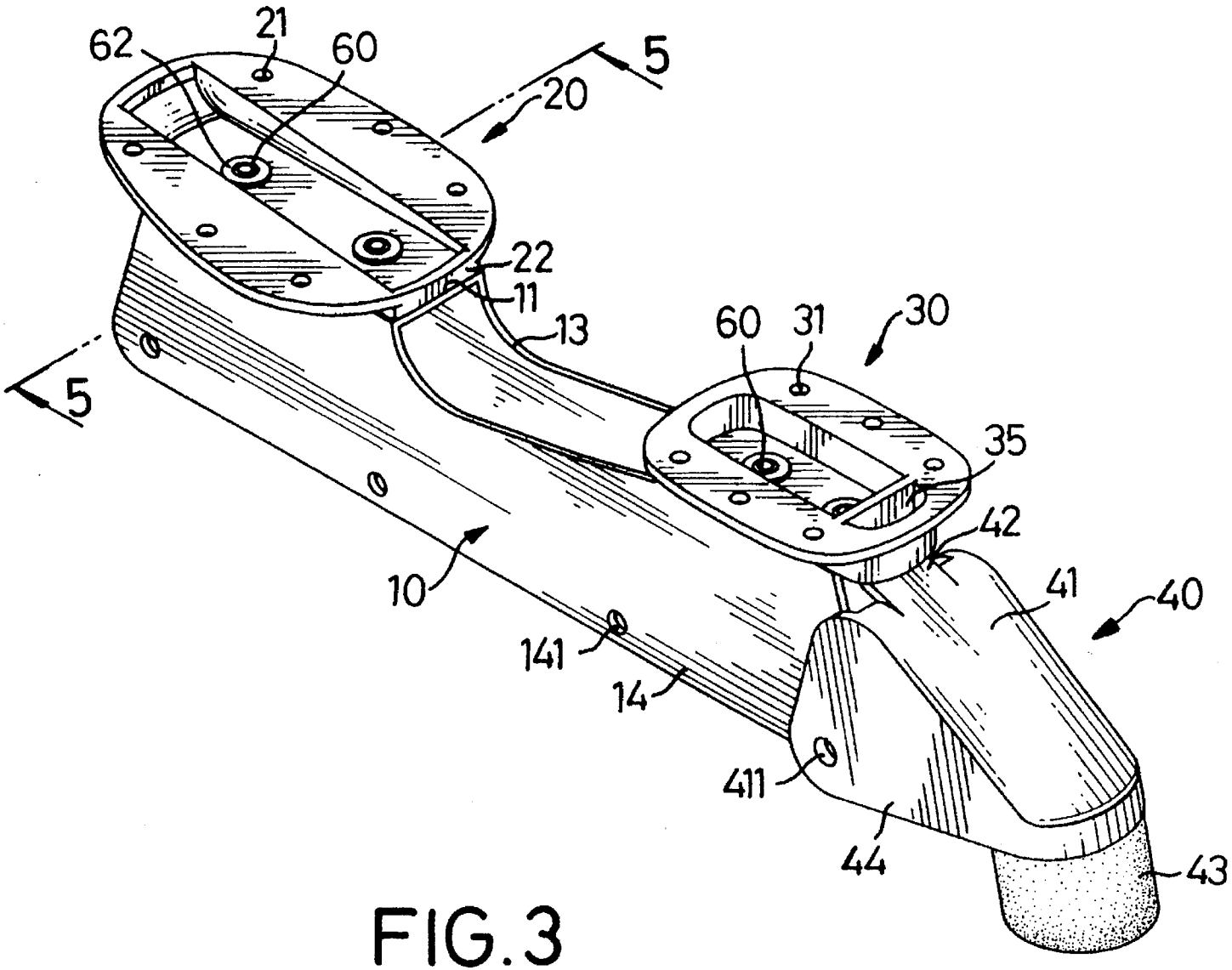
FIG. 3 is a perspective view showing that the parts in FIG. 1 are assembled together.

Now please also refer to FIG. 3. The front sole attaching portion 20 is mounted to the body portion 10 by placing the base 22 on the front plate 11 and then extending two rivets 60 through the rivet receiving holes 111 defined in the front plate 11 and the rivet receiving holes 23 defined in the base 22 and finally fixedly engaging the two rivets 60 with two washers 62 at a location within the recess 28.

The heel sole attaching portion 30 is mounted to the body 10 by placing the base 32 on the rear plate 12 and then extending the other two rivets 60 through the rivet receiving holes 121 defined in the rear plate 12 and the rivet receiving holes 33 defined in the base 32 and finally fixedly engaging the other two rivets 60 with the other two washers 62 at a location within the recess 38.

The brake assembly 40 is mounted onto the body portion 10 by inserting the tongue 42 of the housing 41 into the cavity 35 defined in the heel sole attaching portion 30 and then pivoting the housing 41 about the tongue 42 and toward the body portion 10 until the holes 411 defined in the side walls 44 align with the rear-most pair of holes 141 defined in the side walls 14 of the body portion 10, wherein the side walls 44 are located outside of the side walls 14.

Figure 4:
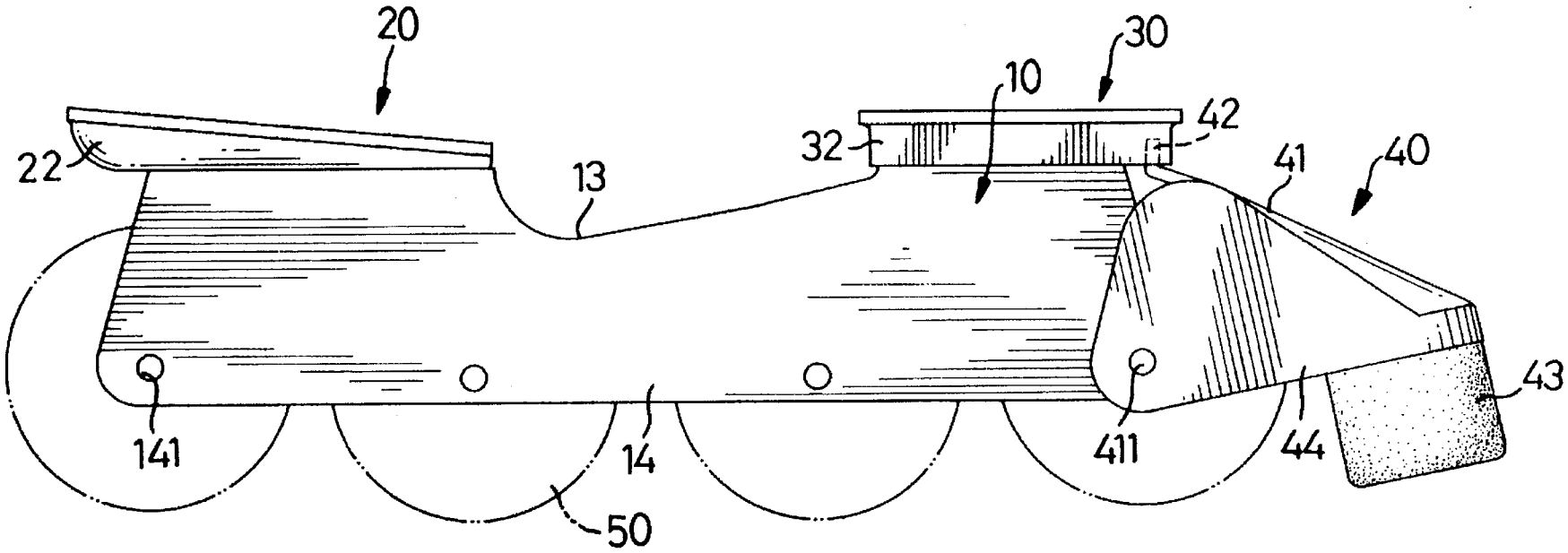
FIG. 4 is a side view of FIG. 3, wherein four wheels indicated by phantom lines are mounted on the frame and a tongue of a brake assembly which is inserted into a heel sole attaching portion is indicated by dotted lines.

Referring to FIG. 4, four wheels 50 are mounted on the body portion 10 by means of four wheel shaft assemblies extending through the four pairs of holes 141 defined in the side walls 14 of the body portion 10, wherein one wheel shaft assembly also extends through the holes 411 defined in the side walls 44 of the brake assembly 40 thereby to pivotably attach the brake assembly 40 to the body portion 10. By the virtue of the tongue 42 being inserted into the heel sole attaching portion 30 and the side walls 44 being pivotably attached to the side walls 14, the brake assembly 40 can be held in the position as shown in FIG. 4 and is allowed to have a limited pivoting movement about the wheel shaft assembly extending through the walls 44 defining the holes 411.

When the brake assembly 40 is used to cause a braking force on the in-line roller skate incorporating the present invention by pushing down the braking block 43 against a ground surface, the heel sole attaching portion 30 can provide a reactive force on the brake assembly 40 through its engagement with the tongue 42.

From FIG. 4, it can be clearly seen that a front end of the base 22 has a level higher than that of a rear end thereof, thereby to cause the front sole attaching portion 20 to decline from a front end to a rear end thereof. The base 32 has a uniform height. The heel sole attaching portion 30 has a level always higher than that of the front sole attaching portion 20 whereby the in-line roller skate incorporating the present invention provides a better control of direction for the user.

Figure 5:
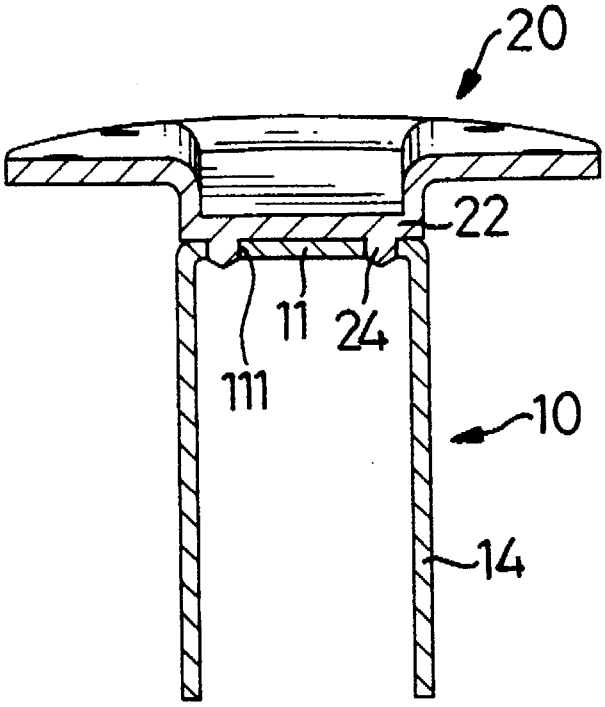
FIG. 5 is a cross-sectional view taken along line 5—5 of FIG. 3.

Finally, referring to FIG. 5, when the front sole attaching portion 20 is mounted on the body portion 10 by placing the base 22 on the front plate 11, the locating protrusions 24 formed on the bottom face of the base 22 are engaged with the front plate 11 defining the locating holes 111, which cooperates with the fastening achieved by the rivets 60 and washers 62 as explained in reference to FIG. 3 and can generate a very firm and reliable connection between the body portion 10 and the front sole attaching portion 20. This feature is also applied to the connection between the body portion 10 and the heel sole attaching portion 30.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed:

1. A frame for an in-line roller skate, adapted to receive a boot and a plurality of wheels thereon, comprising:

a body portion formed by extrusion molding of aluminum alloy and configured to have a front plate, a rear plate and a pair of side walls each extending down from and between the front and rear plates, said side walls defining a plurality of pairs of holes adapted to receive wheel shaft assemblies;

a front sole attaching portion formed by a plastic molding and configured to have an inclined top face, said front sole attaching portion being fixedly attached on the front plate in a manner that the inclined top face is declined from a front end toward a rear end of the body portion;

a heel sole attaching portion formed by a plastic molding and configured to have a flat top face, said heel sole attaching portion being fixedly attached on the rear plate with the flat top face having a level higher than that of the inclined top face of the front sole attaching portion; and a brake assembly comprising a housing and a braking block fixedly attached to the housing, said housing being formed by a plastic molding and configured to have a top tongue engaging the heel sole attaching portion and a pair of side walls pivotably connected with the side walls of the body portion.

2. A frame for an in-line roller skate in accordance with claim 1, wherein said front plate and rear plate each define two rivet receiving holes and two locating holes wherein a line connecting the two rivet receiving holes and a line connecting the two locating holes substantially define a Latin cross.

3. A frame for an in-line roller skate in accordance with claim 2, wherein the front sole attaching portion is configured to have a base and a pair of inclined sole attaching flanges defining a portion of the top face of the front sole attaching portion, said attaching flanges being integrally formed with the base and extending beside and above the base with a recess being defined in a top face of the base and between said attaching flanges, a plurality of pairs of sole fastening holes being defined in the sole attaching flanges, a pair of locating protrusions being formed on a bottom face of the base and a pair of rivet receiving holes being defined in the base whereby when the front sole attaching portion is attached on the front plate, the locating protrusions thereof are engaged with the locating holes of the front plate and the rivet receiving holes thereof are aligned with those of the front plate so that two rivet assemblies including two rivets and washers can be used to fixedly connect the front sole attaching portion and the front plate together.

4. A frame for an in-line roller skate in accordance with claim 2, wherein the heel sole attaching portion is configured to have a base, a pair of flat sole attaching flanges defining a portion of the top face of the heel sole attaching portion and a cavity located at a rear end of the heel sole attaching portion, said attaching flanges being integrally formed with the base and extending beside and above the base with a recess being defined in a top face of the base and between said attaching flanges, a plurality of pairs of sole fastening holes being defined in the sole attaching flanges, a pair of locating protrusions being formed on a bottom face of the base and a pair of rivet receiving holes being defined in the base whereby when the heel sole attaching portion is attached on the rear plate, the locating protrusions thereof are engaged with the locating holes of the rear plate and the rivet receiving holes thereof are aligned with those of the rear plate so that two rivet assemblies including two rivets and washers can be used to fixedly connect the heel sole attaching portion and the rear plate together.

5. A frame for an in-line roller skate in accordance with claim 4, wherein the tongue of the housing of the brake assembly is inserted into the cavity of the heel sole attaching portion and engages with the heel sole attaching portion, and the side walls of the housing of the brake assembly are located outside of the side walls of the body portion and pivotably connected therewith by means of a wheel shaft assembly.

6. A frame for an in-line roller skate in accordance with claim 1, wherein a curved cutout is defined on the body portion and located between the front plate and the rear plate.

* * * * *